US009994426B1

(12) United States Patent
Zhu et al.

(10) Patent No.: US 9,994,426 B1
(45) Date of Patent: Jun. 12, 2018

(54) LAP JOINT PLATFORM OF LARGE-LOAD LIFTING CONTAINER

(71) Applicant: CHINA UNIVERSITY OF MINING AND TECHNOLOGY, Jiangsu (CN)

(72) Inventors: Zhencai Zhu, Jiangsu (CN); Guohua Cao, Jiangsu (CN); Yang Yang, Jiangsu (CN); Weihong Peng, Jiangsu (CN); Yuxing Peng, Jiangsu (CN); Gongbo Zhou, Jiangsu (CN); Wei Li, Jiangsu (CN); Shanzeng Liu, Jiangsu (CN)

(73) Assignee: CHINA UNIVERSITY OF MINING AND TECHNOLOGY (CN)

( * ) Notice: Subject to any disclaimer, the term of this patent is extended or adjusted under 35 U.S.C. 154(b) by 41 days.

(21) Appl. No.: 15/112,392

(22) PCT Filed: Jul. 9, 2015

(86) PCT No.: PCT/CN2015/083625

§ 371 (c)(1),
(2) Date: Jul. 18, 2016

(87) PCT Pub. No.: WO2016/008380

PCT Pub. Date: Jan. 21, 2016

(30) Foreign Application Priority Data

Jul. 16, 2014 (CN) ..... 2014 1 0340314

(51) Int. Cl.
*B66B 17/00* (2006.01)
*B66B 17/18* (2006.01)

(52) U.S. Cl.
CPC ..... *B66B 17/18* (2013.01)

(58) Field of Classification Search
CPC ..... B66B 17/18
USPC ..... 14/69.5, 71.3
See application file for complete search history.

(56) References Cited

U.S. PATENT DOCUMENTS 3,444,574 A 5/1969 Le Clear ..... B65G 11/00
3,583,579 A * 6/1971 Triggs ..... B65G 57/302 414/413
3,699,599 A * 10/1972 Lapham ..... B65G 69/2852 14/71.3
4,134,501 A * 1/1979 Tune ..... B66F 7/22 187/204
4,926,973 A * 5/1990 Smith ..... A61G 3/063 187/213

(Continued)

FOREIGN PATENT DOCUMENTS

CN 101481067 7/2009 ..... B66B 17/16
CN 102602788 7/2012 ..... B66B 5/00

(Continued)

OTHER PUBLICATIONS

International Search Report issued in corresponding PCT Patent Appln. No. PCT/CN2015/083625, dated Sep. 22, 2015, with English translation (6 pgs).

(Continued)

*Primary Examiner* — Raymond W Addie
(74) *Attorney, Agent, or Firm* — Hayes Soloway P.C.

(57) ABSTRACT

A lap joint platform of a large-load lifting container includes a machine frame, a rocker arm platform, a rear rocker arm platform, locking and loading devices. The lap joint platform is stable in loading and unloading processes.

6 Claims, 5 Drawing Sheets

(56) References Cited

U.S. PATENT DOCUMENTS

| | | | | |
|---|---|---|---|---|
| 5,054,578 | A * | 10/1991 | Smillie, III | B60R 5/04 182/141 |
| 6,059,527 | A * | 5/2000 | Ranken | B60P 1/4435 414/540 |
| 6,435,804 | B1 * | 8/2002 | Hutchins | B60P 1/4414 187/200 |
| 8,122,553 | B1 * | 2/2012 | Johnson | B60P 1/433 14/71.1 |
| 2015/0037125 | A1 | 2/2015 | Zhu et al. | 414/639 |

FOREIGN PATENT DOCUMENTS

| | | | |
|---|---|---|---|
| CN | 103818812 | 5/2014 | B66B 17/16 |
| CN | 104150324 | 11/2014 | B66B 11/00 |
| DE | 34 24 573 | 1/1986 | B66B 17/18 |

OTHER PUBLICATIONS

Written Opinion issued in corresponding PCT Patent Appln. No. PCT/CN2015/083625, dated Sep. 9, 2015. (4 pgs).

* cited by examiner

LAP JOINT PLATFORM OF LARGE-LOAD LIFTING CONTAINER

TECHNICAL FIELD

The present invention relates to a lap joint platform for a large-load lifting container, particularly, to a carrying and stabling device adapted for loading and unloading procedures of a large cage or a lift car of a large-tonnage special elevator.

BACKGROUND ART

The existing lap joint platform of large-load lifting container, particularly, a cage-supporting and cage-stabilizing device for the large cage mainly has the problem of instability during the loading and unloading procedures, rendering the increase of lifting cycling time, falling of the tramcar from the rail and insecurity for personnel to enter and exit. When the heavy equipment enters or exits the cage, it could not effectively ensure that the personnel and equipment enters or exits the cage in a convenient, reliable, and stable manner.

SIEMAG Company, abroad, researches and develops a lifting container locking device. By inserting a locking plug to a base seat of the lifting container, the container is tightly locked to stabilize the lifting container for loading and unloading operations. Such a locking device has disadvantages of high costs for manufacturing, requiring accurate stopping location, tedious operations, inevitable need of Siemens electronic control, and the like.

In addition, China University of Mining and Technology develops a cage-supporting and cage-stabilizing device. By using a support oil cylinder to push the support pawl, which rotates around a fixed point to support the cage, and using the cage-stabilizing oil cylinder to tightly fix the rocker arm platform, thereby the cage-stabilizing block is tightly locked, to ensure the stability of the cage during the loading and unloading procedures. The disadvantage of such cage-supporting and cage-stabilizing device lies in a small compensation height for the steel wire rope, i.e., a small compensation for the steel wire rope elastic shrinkage caused by variation in terminal end load , and the service life of the oil cylinder is affected when the oil cylinder works at swinging condition.

CONTENTS OF INVENTION

Purpose of the present invention: the purpose of the present invention is to provide a lap joint platform of a large-load lifting container which provides stable loading and unloading procedures, is easy to operate, and has a high steel wire rope compensation height, in view of disadvantages of the existing lap joint platform of lifting container.

In order to achieve the aforementioned purpose, the present invention adopts the following technical solution:

A lap joint platform of a large-load lifting container, includes a machine frame, a rocker arm platform, a rear rocker arm platform, a locking device and a lifting device;

wherein the rocker arm platform is hinged with a top portion of the machine frame via a shaft set, the rocker arm platform is provided with a mine car rails and a rubber-tire vehicle support surface, and the rear rocker arm platform is fixed to the top portion of the machine frame via bolts;

the locking device is disposed below the rocker arm platform; the locking device includes a locking lower sliding block cover plate, a locking lower sliding block, a locking upper sliding block, a locking oil cylinder front support, a locking lower sliding block guide rail, a locking inclined rail and a locking oil cylinder; the locking inclined rail is fixed with the rocker arm platform; the locking lower sliding block guide rail is fixed with the machine frame; the locking upper sliding block is clamped and sleeved on the locking inclined rail and is slidable along the locking inclined rail; the locking lower sliding block is fixed on the locking lower sliding block guide rail via the locking lower sliding block cover plate and is slidable along a lower sliding block guide rail; the locking lower sliding block is hinged with the locking upper sliding block via a hinge pin; the locking oil cylinder is fixed with the support on the machine frame; a piston rod of the locking oil cylinder is connected to the locking oil cylinder front support; and the locking oil cylinder front support is fixed on the locking lower sliding block; and the lifting device is located below the locking device; the lifting device includes a connecting rod lower support, a support pawl connecting rod, a support pawl push rod, a support pawl, a support pawl rear support, a support oil cylinder rear base, a support oil cylinder, an anti-collision buffer rear base, an anti-collision buffer and a support guide block; the connecting rod lower support, the support pawl rear support, the support oil cylinder rear base and the anti-collision buffer rear base are fixed on the machine frame; the support oil cylinder is hinged with the support oil cylinder rear base; the piston rod of the support oil cylinder is connected to an end of the support pawl push rod via the support guide block; the other end of the support pawl push rod is hinged with the support pawl; an end of the support pawl is embedded in a groove of the support pawl rear support; an end of the support pawl connecting rod is hinged with the connecting rod lower support; the other end of the support pawl connecting rod is hinged with a middle portion of the support pawl push rod; an end of the anti-collision buffer is hinged with the support pawl rear support; and the other end of the anti-collision buffer is hinged with the anti-collision buffer rear base.

In the present invention, preferably, the lifting device further includes a support pawl curve rail disposed on the machine frame; the support pawl curve rail includes a lower inclined curve rail section and an upper vertical curve rail section; a convex shaft is provided on both sides of the support pawl; and the convex shaft is clamped and sleeved on the support pawl curve rail and is slidable along the support pawl curve rail.

In the present invention, preferably, the locking device further includes a rocker arm bound protect upper wedge block and a rocker arm bound protect lower wedge block; the rocker arm bound protect upper wedge block is fixed at a bottom portion of the rocker arm platform; the rocker arm bound protect lower wedge block is fixed at the top portion of the machine frame; and a lower surface of the rocker arm bound protect upper wedge block and an upper surface of the rocker arm bound protect lower wedge block are jointed to each other.

In the present invention, preferably, two locking devices are provided, and symmetrically disposed below the rocker arm platform, and the locking lower sliding blocks of the two locking devices are connected through a connecting joist steel of the locking lower sliding block. In the present invention, preferably, several lifting devices are provided and disposed below the locking device at intervals.

In the present invention, preferably, the top surface of the rocker arm platform is further provided with a car pusher groove, and the car pusher groove includes two U-shaped steels oppositely disposed.

As compared with the lap joint platform of lifting container, the present invention has the following advantages:

(1) easy to operate, shortening lifting cycling time, and increasing lifting efficiency;

(2) having a reliable function of carrying and stabling the lifting container, and improving reliability and stability of heavy equipment when it entering and exiting the lifting container;

(3) adjusting motions of the support pawl by setting the support pawl curve rail, wherein after first finishing motions of rotation and stretching out, the support pawl then performs a motion of vertically supporting cage and compensating, thereby increasing the compensation height for the steel wire rope; and (4) providing a surface contact between the support pawl and the lifting container, to reduce the stress applied on the support pawl, and increase the service life.

Figure 1:
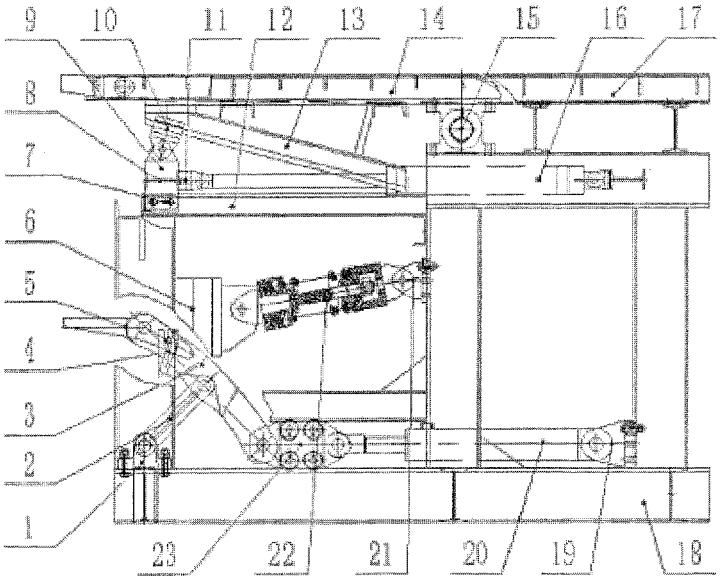
FIG. 1 is a structural front view of the lap joint platform of the present invention.

In the drawings: 1-connecting rod lower support, 2-support pawl connecting rod, 3-support pawl push rod, 4-support pawl curve rail, 4-1-lower inclined curve rail section, 4-2-upper vertical curve rail section, 5-support pawl, 6-support pawl rear support, 7-locking lower sliding block cover plate, 8-locking lower sliding block connecting joist steel, 9-locking lower sliding block, 10-locking upper sliding block, 11-locking oil cylinder front support, 12-locking lower sliding block guide rail, 13-locking inclined rail, 14-rocker arm platform, 15-shaft set, 16-locking oil cylinder, 17-rear rocker arm platform, 18-machine frame, 19-support oil cylinder rear base, 20-support oil cylinder, 21-anti-collision buffer rear base, 22-anti-collision buffer, 23-support guide block, 24-mine car rails, 25-U-shaped steel, 26-rubber-tire vehicle support surface, 27-rocker bound protect upper wedge block, and 28-rocker hound protect lower wedge block.

DETAILED DESCRIPTION OF THE INVENTION

The present invention is further explained with reference to the accompanying drawings.

Figure 2:
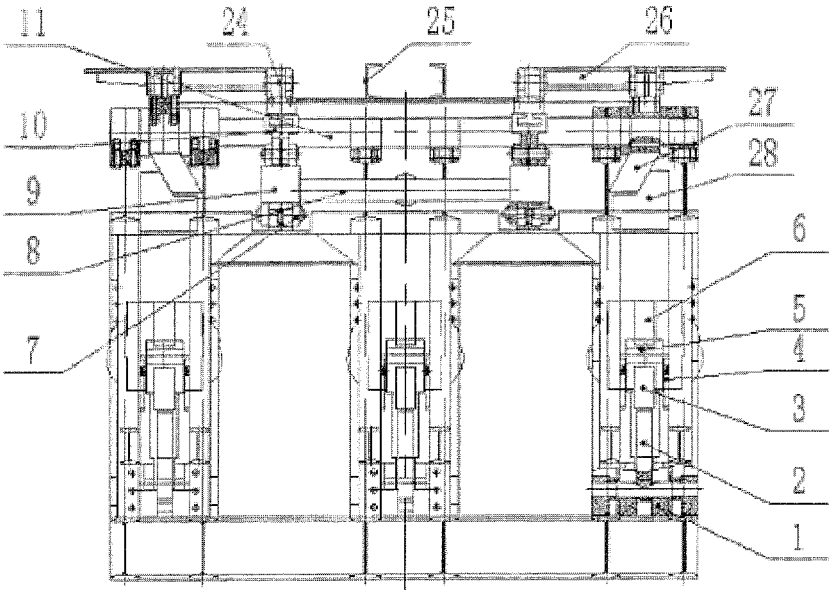
FIG. 2 is a structural left view of the lap joint platform of the present invention.

As shown in FIGS. 1 and 2, a lap joint platform of a large-load lifting container of the present invention includes a machine frame 18, a rocker arm platform 14, a rear rocker arm platform 17, a locking device and a lifting device.

The rocker arm platform 14 is hinged with an upper portion of the machine frame 18 via a shaft set 15, a top surface of the rocker arm platform 14 is provided with a mine car rails 24, a rubber-tire vehicle support surface 26 and a car pusher groove. The car pusher groove includes two oppositely disposed U-shaped steels 25, and the U-shaped steel 25 is welded and fixed on the rocker arm platform 14. The mine car rails 24 is used to support the tramcar to enter and exit the lifting container, the rubber-tire vehicle support surface 26 is used to support a no support and trackless rubber-tire vehicle to enter and exit the lifting container, and the car pusher groove is used to place cart tools, to function as a guide rail. The rear rocker arm platform 17 is fixed to the top portion of the machine frame 18 via bolts, and the rear rocker arm platform 17 functions as a transition from the ground to the rocker arm platform 14.

Two locking devices are provided, and symmetrically disposed below the rocker arm platform 14, and the locking device includes a locking lower sliding block cover plate 7, a locking lower sliding block connecting joist steel 8, a locking lower sliding block 9, a locking upper sliding block 10, a locking oil cylinder front support 11, a locking lower sliding block guide rail 12, a locking inclined rail 13, a locking oil cylinder 16, a rocker arm bound protect upper wedge block 27 and a rocker arm bound protect lower wedge block 28. The locking inclined rail 13 is fixed with the rocker arm platform 14; the locking lower sliding block guide rail 12 is fixed with the machine frame 18; the locking upper sliding block 10 is clamped and sleeved on the locking inclined rail 13, and is slidable along the locking inclined rail 13; the locking lower sliding block 9 is fixed on the locking lower sliding block guide rail 12 via the locking lower sliding block cover plate 7 and is slidable along a lower sliding block guide rail 12; the locking lower sliding block 9 is hinged with the locking upper sliding block 10 via a hinge pin; the locking oil cylinder 16 is fixed with the support seat on the machine frame 18; a piston rod of the locking oil cylinder 16 is connected to the locking oil cylinder front support 11; and the locking oil cylinder front support 11 is fixed on the locking lower sliding block 9. The locking lower sliding block 9 can be driven by the concertina movement of the piston rod of the locking oil cylinder 16 to slide along the locking inclined rail 13; and the locking lower sliding block 9 drives the locking upper sliding block 10 to slide along the locking inclined rail 13 and to jack the locking inclined rail 13 up, thereby driving the rocker arm platform 14 to swing up and down around the shaft set 15. In order to enable the two locking devices to move synchronously, the locking lower sliding blocks 9 of the two locking devices are connected through a connecting joist steel 8 of the locking lower sliding block. The rocker arm bound protect upper wedge block 27 is fixed to the bottom portion of the rocker arm platform 14; the rocker arm bound protect lower wedge block 28 is fixed to the top portion of the machine frame 18; and the lower surface of the rocker arm bound protect upper wedge block 27 and the upper surface of the rocker arm bound protect lower wedge block 28 are jointed to each other. Swinging of the rocker arm platform 14 in a horizontal direction during the loading and unloading procedures of the lifting container is prevented by jointing the rocker arm bound protect upper wedge block 27 and the rocker arm bound protect lower wedge block 28.

Several lifting devices are provided and disposed below the locking device at intervals. The lifting device includes a connecting rod lower support 1, a support pawl connecting rod 2, a support pawl push rod 3, a support pawl 5, a support pawl rear support 6, a support oil cylinder rear base 19, a support oil cylinder 20, an anti-collision buffer rear base 21, an anti-collision buffer 22 and a support guide block 23. The connecting rod lower support 1, the support pawl rear support 6, the support oil cylinder rear base 19 and the anti-collision buffer rear base 21 are fixed on the machine frame 18. The support oil cylinder 20 is hinged with the support oil cylinder rear base 19; the piston rod of the support oil cylinder 20 is connected to an end of the support pawl push rod 3 via the support guide block 23; the other end of the support pawl push rod 3 is hinged with the support pawl 5; and an end of the support pawl 5 is embedded in the groove of the support pawl rear support 6. One end of the support pawl connecting rod 2 is hinged with the connecting rod lower support 1; the other end of the support pawl connecting rod 2 is hinged with the middle portion of the support pawl push rod 3; one end of the anti-collision buffer 22 is hinged with the support pawl rear support 6; and the other end of the anti-collision buffer 22 is hinged with the anti-collision buffer rear base 21.

Figure 3:
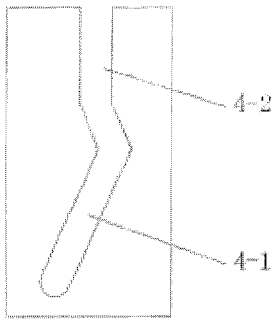
FIG. 3 is a structural schematic diagram of the support pawl curve rail of the lap joint platform of the present invention.
Figure 4:
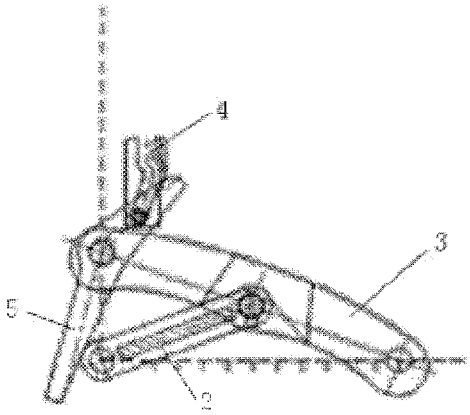
FIG. 4 is a schematic diagram I of the support pawl motion of the lap joint platform of the present invention.
Figure 5:
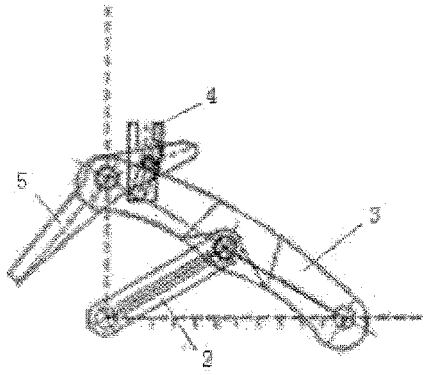
FIG. 5 is a schematic diagram II of the support pawl motion of the lap joint platform of the present invention.
Figure 6:
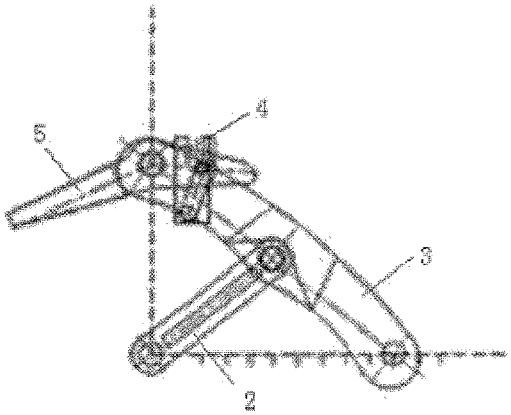
FIG. 6 is a schematic diagram III of the support pawl motion of the lap joint platform of the present invention.
Figure 7:
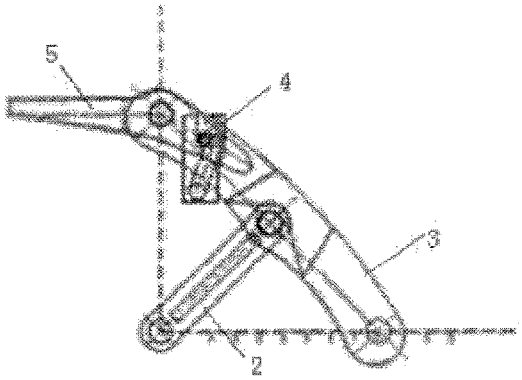
FIG. 7 is a schematic diagram IV of the support pawl motion of the lap joint platform of the present invention.
Figure 8:
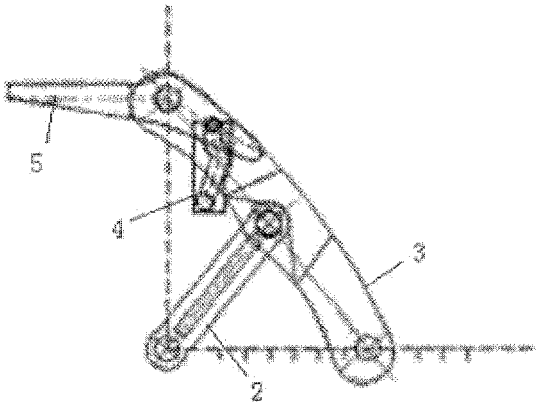
FIG. 8 is a schematic diagram V of the support pawl motion of the lap joint platform of the present invention.
Figure 9:
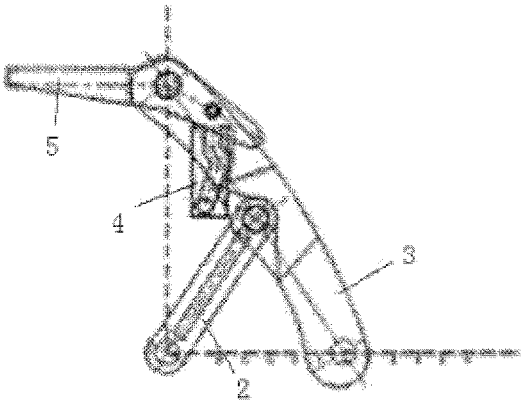
FIG. 9 is a schematic diagram VI of the support pawl motion of the lap joint platform of the present invention.
Figure 10:
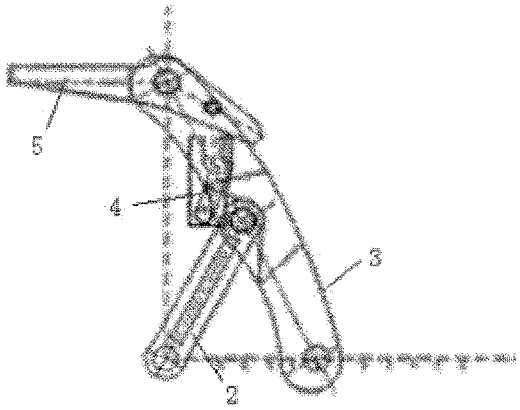
FIG. 10 is a schematic diagram VII of the support pawl motion of the lap joint platform of the present invention.
Figure 11:
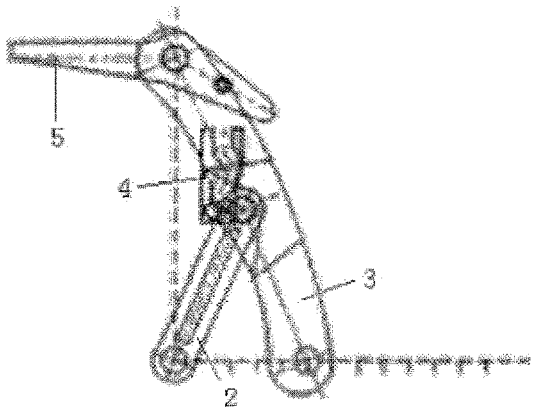
FIG. 11 is a schematic diagram VIII of the support pawl motion of the lap joint platform of the present invention.
Figure 12:
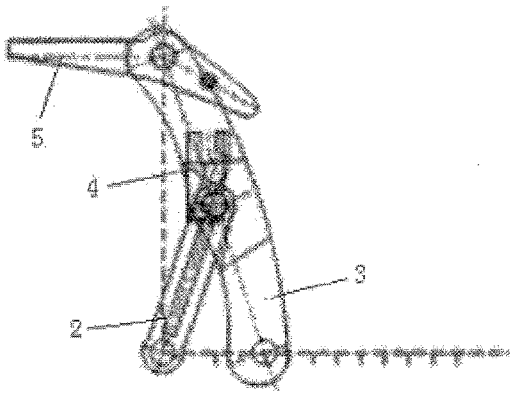
FIG. 12 is a schematic diagram IX of the support pawl motion of the lap joint platform of the present invention.

As shown in FIGS. 1 and 3, in order to facilitate the motion of the support pawl 5, the lifting device further includes the support pawl curve rail 4 disposed on the machine frame 18, and the support pawl curve rail 4 includes a lower inclined curve rail section 41 and an upper vertical curve rail section 42. A convex shaft is provided on two sides of the support pawl 5, and the convex shaft is clampled and sleeved on the support pawl curve rail 4 via a bearing and is slidable along the support pawl curve rail 4.

The movements of the support pawl 5 of the lap joint platform of the present invention include two procedures, i.e. rotating and stretching out, and vertically compensating. As shown in FIGS. 4 to 7, the support pawl 5 completes the motion of rotating to a horizontal plane for stretching out at the lower inclined curve rail section 41 of the support pawl curve rail 4; and as shown in FIGS. 7 to 12, the support pawl 5 completes the motion of vertically supporting cage and compensating at the upper vertical curve rail section 42 of the support pawl curve rail 4. The support pawl of the existing lap joint platform of the same type only has the motion of rotating and stretching out, steel wire rope compensation height only is height difference generated by the pawl to rotate, while the lap joint platform of the present invention adjusts the motion of the support pawl 5 by setting the support pawl curve rail 4, and the support pawl 5 first completes the motion of rotating and stretching out, and then performs the motion of vertically supporting cage and compensating, thereby increasing the compensation height for the steel wire rope.

The operational method of the lap joint platform of the present invention is:

When the lifting container reaches a supporting location, the support oil cylinder 20 moves to push the support guide block 23, and the support guide block 23 drives the support pawl push rod 3 to rotate, so that the support pawl 5 slides in the support pawl curve rail 4. The support pawl 5 first complete the motion of rotating and stretching out, then is jointed to the supporting surface of the lifting container, to upwardly slide along the support pawl curve rail 4, to lift the entire lifting container to move upwards, to perform vertical cage lifting compensation. After the cage lifting compensation operation is competed by the support pawl 5, the locking oil cylinder 16 starts to move. The piston rod of the locking oil cylinder 16 stretches out to push the locking lower sliding block 9 to move forward, thereby driving the locking upper sliding block 10 to slide along the locking inclined rail 13. The rocker arm platform 14 correspondingly swings downwards to butt joint with the lifting container, and then starts the loading and unloading operations. After the loading and unloading operations are completed, the locking oil cylinder 16 first moves, and the piston rod of the locking oil cylinder 16 shrinks to drive the rocker arm platform 14 to swing upwards to the initial location; then the support oil cylinder 20 moves, and the piston rod of the support oil cylinder 20 shrinks to drive the support pawl 5 to move downwards, turn over and retrieve to the initial location. Hence, the lap joint platform completes a working cycle.

The above-mentioned contents are merely preferable embodiments of the present invention. It should be pointed out that, for persons having ordinary skill in the art, under the premise of not departing from the principle of the present invention, several improvements and modifications can also be made, and such improvements and modifications can also be considered as being within the protection scope of the present invention.

The invention claimed is:

1. A lap joint platform of a large-load lifting container, comprising a machine frame (18), a rocker arm platform (14), a rear rocker arm platform (17), a locking device and a lifting device;

the rocker arm platform (14) is hinged with a top portion of the machine frame (18) via a shaft set (15), the rocker arm platform (14) is provided with a mine car rails (24) and a rubber-tire vehicle support surface (26), and the rear rocker arm platform (17) is fixed to the top portion of the machine frame (18) via bolts;

the locking device is disposed below the rocker arm platform (14); the locking device includes a locking lower sliding block cover plate (7), a locking lower sliding block(9), a locking upper sliding block (10), a locking oil cylinder front support (11), a locking lower sliding block guide rail (12), a locking inclined rail (13) and a locking oil cylinder (16); the locking inclined rail (13) is fixed with the rocker arm platform (14); the locking lower sliding block guide rail (12) is fixed with the machine frame (18); the locking upper sliding block(10) is clamped and sleeved on the locking inclined rail (13) and is slidable along the locking inclined rail (13); the locking lower sliding block(9) is fixed on the locking lower sliding block guide rail (12) via the locking lower sliding block cover plate (7) and is slidable along a lower sliding block guide rail (12); the locking lower sliding block(9) is hinged with the locking upper sliding block (10) via a hinge pin; the locking oil cylinder (16) is fixed with the support seat on the machine frame (18); a piston rod of the locking oil cylinder (16) is connected to the locking oil cylinder front support (11); and the locking oil cylinder front support (11) is fixed on the locking lower sliding block(9); and the lifting device is located below the locking device; the lifting device includes a connecting rod lower support (1), a support pawl connecting rod (2), a support pawl push rod (3), a support pawl (5), a support pawl rear support (6), a support oil cylinder rear base (19), a support oil cylinder (20), an anti-collision buffer rear base (21), an anti-collision buffer (22) and a support guide block (23); the connecting rod lower support (1), the support pawl rear support (6), the support oil cylinder rear base (19) and the anti-collision buffer rear base (21) are fixed on the machine frame (18); the support oil cylinder (20) is hinged with the support oil cylinder rear base (19); the piston rod of the support oil cylinder (20) is connected to an end of the support pawl push rod (3) via the support guide block (23); the other end of the support pawl push rod (3) is hinged with the support pawl (5); an end of the support pawl (5) is embedded in a groove of the support pawl rear support (6); an end of the support pawl connecting rod (2) is hinged with the connecting rod lower support (1); the other end of the support pawl connecting rod (2) is hinged with a middle portion of the support pawl push rod (3); an end of the anti-collision buffer (22) is hinged with the support pawl rear support (6); and the other end of the anti-collision buffer (22) is hinged with the anti-collision buffer rear base (21).

2. The lap joint platform of a large-load lifting container according to claim 1, wherein the lifting device further includes a support pawl curve rail (4) disposed on the machine frame (18); the support pawl curve rail (4) includes a lower inclined curve rail section (41) and an upper vertical curve rail section (42); a convex shaft is provided on both sides of the support pawl (5); and the convex shaft is clamped and sleeved on the support pawl curve rail (4) and is slidable along the support pawl curve rail (4).

3. The lap joint platform of a large-load lifting container according to claim 1, wherein the locking device further includes a rocker arm bound protect upper wedge block (27) and a rocker arm bound protect lower wedge block (28); the rocker arm bound protect upper wedge block (27) is fixed at a bottom portion of the rocker arm platform (14); the rocker arm bound protect lower wedge block (28) is fixed at the top portion of the machine frame (18); and a lower surface of the rocker arm bound protect upper wedge block (27) and an upper surface of the rocker arm bound protect lower wedge block (28) are jointed to each other.

4. The lap joint platform of a large-load lifting container according to claim 1, wherein two locking devices are provided, and symmetrically disposed below the rocker arm platform (14), and the locking lower sliding blocks(9) of the two locking devices are connected through a connecting joist steel (8) of the locking lower sliding block.

5. The lap joint platform of a large-load lifting container according to claim 1, wherein several lifting devices are provided and disposed below the locking device at intervals.

6. The lap joint platform of a large-load lifting container according to claim 1, wherein the top surface of the rocker arm platform (14) is further provided with a car pusher groove, and the car pusher groove includes two oppositely disposed U-shaped steels (25).

* * * * *